US009314752B2

(12) United States Patent
Lee

(10) Patent No.: US 9,314,752 B2
(45) Date of Patent: Apr. 19, 2016

(54) APPARATUS FOR DISPERSING NANOCOMPOSITE MATERIAL

(71) Applicant: Hyundai Motor Company, Seoul (KR)

(72) Inventor: Jong Kook Lee, Suwon (KR)

(73) Assignee: Hyundai Motor Company, Seoul (KR)

( * ) Notice: Subject to any disclaimer, the term of this patent is extended or adjusted under 35 U.S.C. 154(b) by 408 days.

(21) Appl. No.: 13/798,833

(22) Filed: Mar. 13, 2013

(65) Prior Publication Data

US 2014/0169123 A1 Jun. 19, 2014

(30) Foreign Application Priority Data

Dec. 14, 2012 (KR) ..... 10-2012-0146848

(51) Int. Cl.

| | |
|---|---|
| ***B01F 9/00*** | (2006.01) |
| ***B02C 15/00*** | (2006.01) |
| ***B01F 13/00*** | (2006.01) |
| ***B01F 3/18*** | (2006.01) |
| *B02C 15/06* | (2006.01) |
| *B02C 15/16* | (2006.01) |
| *B02C 15/08* | (2006.01) |

(52) U.S. Cl.

CPC ..... *B01F 9/0034* (2013.01); *B01F 3/18* (2013.01); *B01F 13/0052* (2013.01); *B01F 2009/0089* (2013.01); *B01F 2215/0477* (2013.01); *B02C 15/06* (2013.01); *B02C 15/08* (2013.01); *B02C 15/16* (2013.01)

(58) Field of Classification Search

CPC ..... B01F 13/0052; B01F 2009/0089; B01F 2215/0477; B01F 3/18; B01F 9/0034; B02C 15/16; B02C 15/06; B02C 15/08

USPC ..... 366/225

See application file for complete search history.

(56) References Cited

U.S. PATENT DOCUMENTS

| | | | | | |
|---|---|---|---|---|---|
| 1,335,269 | A * | 3/1920 | Ball | 241/70 |
| 1,697,531 | A * | 1/1929 | Levitt | 241/18 |
| 2,835,941 | A * | 5/1958 | Muller | 209/34 |
| 3,018,059 | A * | 1/1962 | Lucke et al. | 241/25 |
| 3,862,719 | A * | 1/1975 | Muller | 241/74 |
| 3,867,104 | A * | 2/1975 | Leybourne et al. | 422/137 |
| 4,141,957 | A * | 2/1979 | Szabolcs et al. | 422/135 |
| 5,012,619 | A * | 5/1991 | Knepprath et al. | 451/326 |
| 6,070,817 | A * | 6/2000 | Yanase | 241/171 |
| 2005/0226096 | A1* | 10/2005 | Damhuis | 366/234 |
| 2010/0085834 | A1* | 4/2010 | Kalidindi | 366/226 |
| 2010/0189604 | A1* | 7/2010 | Guasch | 422/102 |
| 2014/0064020 | A1* | 3/2014 | Kalidindi | 366/223 |
| 2014/0169123 | A1* | 6/2014 | Lee | 366/234 |

FOREIGN PATENT DOCUMENTS

| | | |
|---|---|---|
| JP | H05-309249 A | 11/1993 |
| JP | H11-169734 A | 6/1999 |

(Continued)

*Primary Examiner* — Tony G Soohoo

(74) *Attorney, Agent, or Firm* — Mintz Levin Cohn Ferris Glovsky and Popeo, P.C.; Peter F. Corless

(57) ABSTRACT

Disclosed herein is an apparatus for dispersing a nanocomposite material. That apparatus includes an inner chamber in which a metal powder, a nanocomposite material and inner pellets are charged. The inner chamber also includes a plurality of apertures each having a smaller diameter than that of each inner pellet. Furthermore, the apparatus includes an outer chamber that surrounds the inner chamber and includes outer pellets in a space between a wall of the inner chamber and a wall of the outer chamber.

8 Claims, 5 Drawing Sheets

(56) References Cited

FOREIGN PATENT DOCUMENTS

| | | | |
|---|---|---|---|
| KR | 20-0381555 | Y1 | 4/2005 |
| KR | 10-2007-0059914 | | 6/2007 |
| KR | 10-0758341 | B1 | 9/2007 |
| KR | 10-2010-0093315 | A | 8/2010 |
| KR | 10-2011-0032857 | A | 3/2011 |

* cited by examiner

APPARATUS FOR DISPERSING NANOCOMPOSITE MATERIAL

BACKGROUND OF THE INVENTION

1. Technical Field

The present invention relates to an apparatus for dispersing a nanocomposite material, which can improve the dispersibility of a metal powder and a nanocomposite material and prevent nanocomposite molecules from being damaged.

2. Description of the Related Art

Generally, a nanocomposite material is mixed with a metal powder to form an alloy. In addition, to ensure the mechanical characteristics of this alloy are maintained or increased, the metal powder and the nanocomposite material must be sufficiently dispersed. Thus, pellets and raw materials (e.g., metal powder, nanoparticles) are charged in a mixing chamber, and then the mixing chamber is rotated to allow the raw materials to be dispersed by a collision with the pellets. Furthermore, the pellets have a substantially uniform size, and the weight ratio of raw materials to pellets is determined based on the collision energy necessary for the raw materials.

Moreover, the metal powder and nanoparticles are mixed by the rotation force occurring when the mixing chamber rotates and the collision energy occurring when pellets collide with the raw materials. In particular, when the collision energy is substantially large, nanoparticles are damaged. Conversely, when the collision is substantially small, nanoparticles are not sufficiently dispersed. However, the inconsistency in dispersing the nanoparticles causes in difficult when determining an optimal level of dispersion.

A known art discloses a method of manufacturing high reliability carbon nanotube (CNT) paste, including the steps of: (i) dispersing CNT powder in a solvent; (ii) adding an organic binder to the CNT powder dispersed solution; and (iii) performing a milling process to control the viscosity of the CNT powder dispersed solution containing the organic binder, wherein, in step (i) or (ii), metal nanoparticles are added. However, in this conventional it was shown to be difficult to obtain dispersion of a predetermined level or more.

It is to be understood that the foregoing description is provided to merely aid the understanding of the present invention, and does not mean that the present invention falls under the purview of the related art which was already known to those skilled in the art.

SUMMARY

Accordingly, the present invention provides an apparatus that disperses a nanocomposite material, which may improve the dispersibility of a nanocomposite material and prevent nanocomposite molecules from being damaged.

An aspect of the present invention provides an apparatus that disperses a nanocomposite material, including: an inner chamber in which a metal powder, a nanocomposite material and inner pellets are charged, wherein the inner chamber includes a plurality of apertures each having a smaller diameter than that of each inner pellet; and an outer chamber that surrounds the inner chamber and includes outer pellets in a space between a wall of the inner chamber and a wall of the outer chamber.

The diameter of the aperture may be about 3~10 times larger than the metal powder. The diameter of the inner pellets may be about 10~200 times larger than the metal powder. The outer pellets may be larger than the inner pellets. The diameter of the outer pellets may be about 200~1000 times larger than the metal powder.

The apparatus may further include a control unit, operated by a controller and configured to rotate the inner chamber and the outer chamber. In addition, the control unit may be configured to rotate the inner chamber and the outer chamber, wherein the mixing time in the inner chamber is about 5~300 minutes and the mixing time in the outer chamber is about 5~180 minutes.

The apparatus may further include an outermost chamber that surrounds the outer chamber and includes outermost pellets in a space between a wall of the outer chamber and a wall of the outermost chamber, wherein the outer chamber includes with a plurality of apertures each having a smaller diameter than that of each of the outermost pellets. The outermost pellets may be smaller than the outer pellets.

BRIEF DESCRIPTION OF THE DRAWINGS

The above and other objects, features and advantages of the present invention will be more clearly understood from the following detailed description taken in conjunction with the accompanying drawings, in which.

Figure 1:
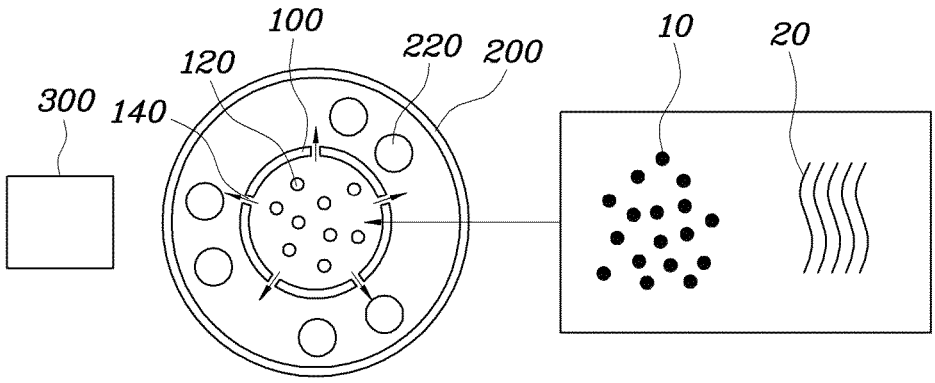
FIGS. 1 to 3 are exemplary views showing the actuation of an apparatus for dispersing a nanocomposite material according to an exemplary embodiment of the present invention.
Figure 2:
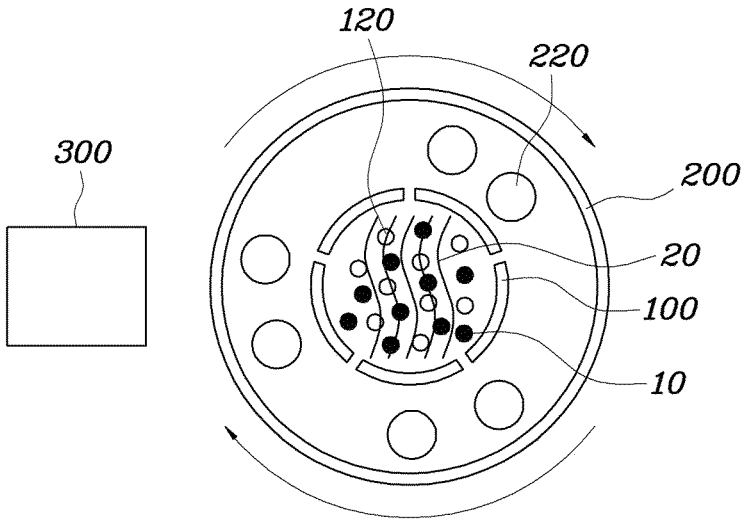
Figure 3:
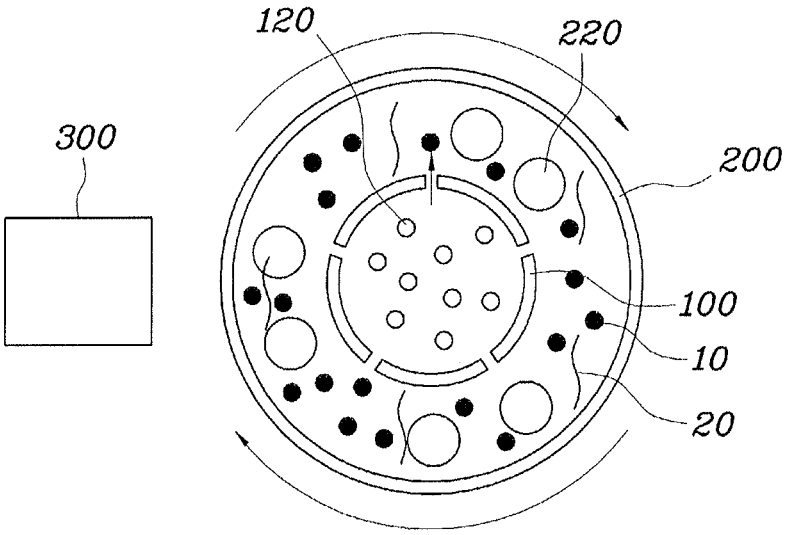

| Reference Numerals | |
|---|---|
| 100: inner chamber | 120: inner pellet |
| 140: aperture | 200: outer chamber |
| 220: outer pellet | |

DETAILED DESCRIPTION

Furthermore, control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/of" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Furthermore, control logic of the present invention may be embodied as non-transitory computer readable media on a computer readable medium containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

Hereinafter, exemplary embodiments of the present invention will be described in detail with reference to the accompanying drawings.

The apparatus for dispersing a nanocomposite material according to the present invention is an apparatus that disperses a metal powder and a nanocomposite material such as carbon nanotubes (CNT), carbon nanofiber (CNF) or the like. The present invention provides an apparatus for dispersing a metal powder and a nanocomposite material, which may increase dispersion and decrease damage according to various designs of dispersion equipment.

As shown in FIG. 1, the apparatus for dispersing a nanocomposite material according to the present invention may include: an inner chamber 100 in which a metal powder 10, a nanocomposite material 20 and a plurality of inner pellets 120 are charged, wherein the inner chamber 100 includes a plurality of apertures 140 each having a smaller diameter than each of the inner pellets 120; and an outer chamber 200 that surrounds the inner chamber 100 and includes a plurality of outer pellets 220 in a space between a wall of the inner chamber 100 and a wall of the outer chamber 200.

The apparatus for dispersing a nanocomposite material may include two chambers, that is, an inner chamber 100 and an outer chamber 200 surrounding the inner chamber 100. Each of the chambers 100 and 200 may be charged with pellets. In other words, the inner chamber 100 may be charged with inner pellets 120, and the space between the wall of the inner chamber 100 and the wall of the outer chamber 200 may be charged with outer pellets 220.

Meanwhile, as shown in FIG. 1, the metal powder 10 and the nanocomposite material 20 may be introduced into the inner chamber 100. When the inner chamber 100 rotates, the metal powder 10 and the nanocomposite material 20 charged in the inner chamber 100 may be mixed. In other words, the metal powder 10 and the nanocomposite material 20 may be mixed by the rotation force occurring when the inner chamber 100 rotates and by the collision energy occurring when the inner pellets 120 collide with the raw materials 10 and 20.

In other words, the metal powder and the nanoparticles may be mixed by the rotation force occurring when the inner chamber 100 rotates and by the collision energy occurring when the inner pellets 120 collide with the raw materials 10 and 20. Furthermore, since the size of each of the inner pellet 120 is substantially small, the collision energy applied to the raw materials 10 and 20 may be substantially low, thus agglomerated nanocomposite materials 20 may be separated from each other rather than the metal powder 10 being mixed with the nanocomposite materials. Therefore, the separation of agglomerated nanocomposite materials 20 contributes to substantially uniform dispersion of the nanocomposite materials 20 in the metal powder.

Additionally, the diameter of the apertures 140 may be about 3~10 times larger than the metal powder 10, and the diameter of the inner pellets 120 may be about 10~200 times larger than the metal powder 10. In other words, the wall of the inner chamber 100 may include a plurality of apertures 140 to allow the metal powder 10 and the nanocomposite material 20 to move from the inner chamber 100 to the outer chamber 200. In particular, each aperture 140 may have a diameter that allows the metal powder 10 and nanocomposite material 20 to move therethrough while simultaneously preventing the inner pellets 120 to move therethrough. Therefore, the diameter of the apertures 140 may be about 3~10 times larger than the metal powder 10 (i.e., when the diameter of the metal powder is about 50 μm, the diameter of the apertures 140 is about 150~500 μm).

When the diameter of the apertures 140 is smaller than the diameter of the metal powder 10 or the nanocomposite material 20, the metal powder 10 or the nanocomposite material 20 may block the aperture 140, and thus the movement through the aperture may be restricted. Further, when the diameter of the aperture 140 is greater than the diameter of metal powder 10 or the nanocomposite material 20, the metal powder 10 or the nanocomposite material 20 may not be sufficiently dispersed, and the inner pellets 120 may move from the inner chamber 100 to the outer chamber 200 through the aperture 140, thus deteriorating the effect of the present invention.

Further, the inner chamber 100 may be surrounded by the outer chamber 200 to form a space between the wall of the inner chamber 100 and the wall of the outer chamber 200, and the space may be charged with the outer pellets 220. The metal powder 10 and the nanocomposite material 20 charged in the inner chamber 100 may move to the outer chamber 200 through the apertures 140 formed in the wall of the inner chamber 100 by a centrifugal force caused by rotation of the inner chamber 100. In addition, the metal powder 10 and the nanocomposite material 20 having moved to the outer chamber 200 may be mixed by the outer pellets 220. In particular, the outer pellets 220 may have a diameter greater than the diameter of the inner pellets 120. Specifically, the diameter of the outer pellets 220 may be about 200~1000 times larger than the inner pellets 120.

Since the metal powder 10 and the nanocomposite material 20 must be substantially uniformly mixed in the outer chamber 200, sufficient energy must be supplied to the metal powder 10. Therefore, the size of the outer pellets 220 must be about 200 times or more larger than the diameter of the metal powder 10. Further, since the outer pellets 220 must be brought into contact with the metal powder 10 or the nanocomposite material 20, the maximum size of the outer pellets 220 may not exceed 1000 times the diameter of the metal powder 10.

Meanwhile, the apparatus for dispersing a nanocomposite material according to the present invention may further include a control unit 300 operated by a controller and configured to rotate the inner chamber 100 and the outer chamber 200. The control unit 300 executes the rotation of the inner chamber 100 and the outer chamber 200 to obtain a mixing time in the inner chamber 100 of about 5~300 minutes and a mixing time in the outer chamber 200 of about 5~180 minutes.

In other words, the mixing process conditions in the inner chamber 100 and the outer chamber 200 may be similar to general mixing process conditions, with the exception of the pellet diameter. However, the mixing time in the outer chamber 200 must not exceed the mixing time in the inner chamber 100. When the mixing time in the outer chamber 200 reaches a predetermined threshold, the nanocomposite material 20 may be damaged, thus deteriorating the expected effects of the present invention, such as substantially uniform mixing, damage minimization and the like. Therefore, in the present invention, the mixing time in the inner chamber 100 may not exceed about 5~300 min and the mixing time in the outer chamber 200 may be about 5~180 min.

Moreover, the inner chamber 100 and the outer chamber 200 may be concentrically and integrally configured to be rotated together. In particular, the mixing time in the inner chamber 100 and the outer chamber 200 is the time that the mixture of the metal powder 10 and the nanocomposite material 20 remains in the inner chamber 100 and the outer chamber 200, respectively. Further, the two chambers 100 and 200 may be configured to be independently rotated and controlled. When the chambers 100 and 200 are independently rotated, the rotation time in each chamber may correspond to the mixing time in each chamber.

Figure 4:
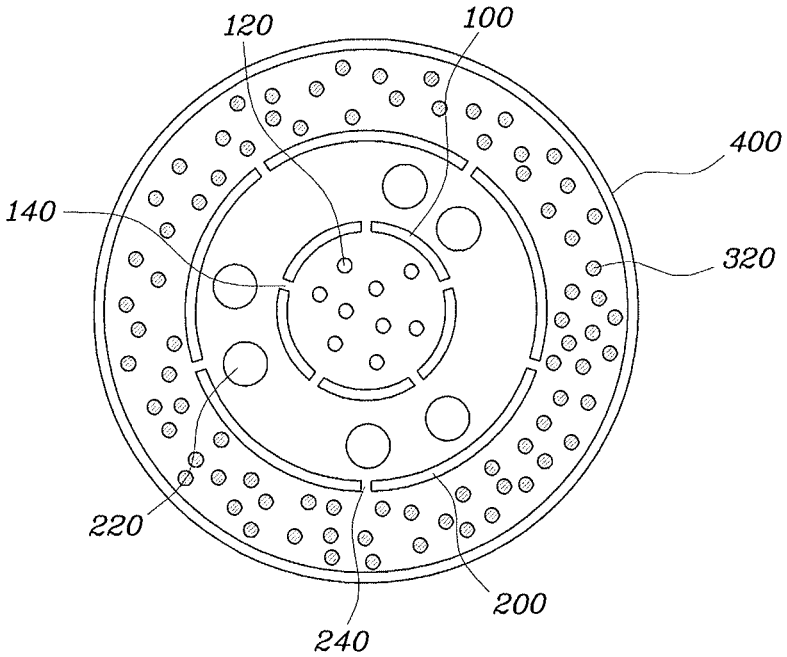
FIG. 4 is an exemplary view showing an apparatus for dispersing a nanocomposite material according to an exemplary embodiment of the present invention.

Meanwhile, FIG. 4 is an exemplary view showing an apparatus for dispersing a nanocomposite material according to another exemplary embodiment of the present invention. The apparatus for dispersing a nanocomposite material according to the exemplary embodiment may further include: an outermost chamber 400 that surrounds the outer chamber 200 and includes a plurality of outermost pellets 320 in a space between the wall of the outer chamber 200 and the wall of the outermost chamber 400, wherein the wall of the outer chamber 200 includes a plurality of apertures 240 each having a smaller diameter than each of the outermost pellets 320. In addition, the outermost pellets 320 may be smaller than the outer pellets 220.

Therefore, when the mixed powder (e.g., metal powder+nanoparticles) mixed by the outer pellets 220 is agglomerated, the agglomerated mixed powder may be further substantially uniformly separated by the outermost pellets 320 disposed between the outer chamber 200 and the outermost chamber 400.

Figure 5:
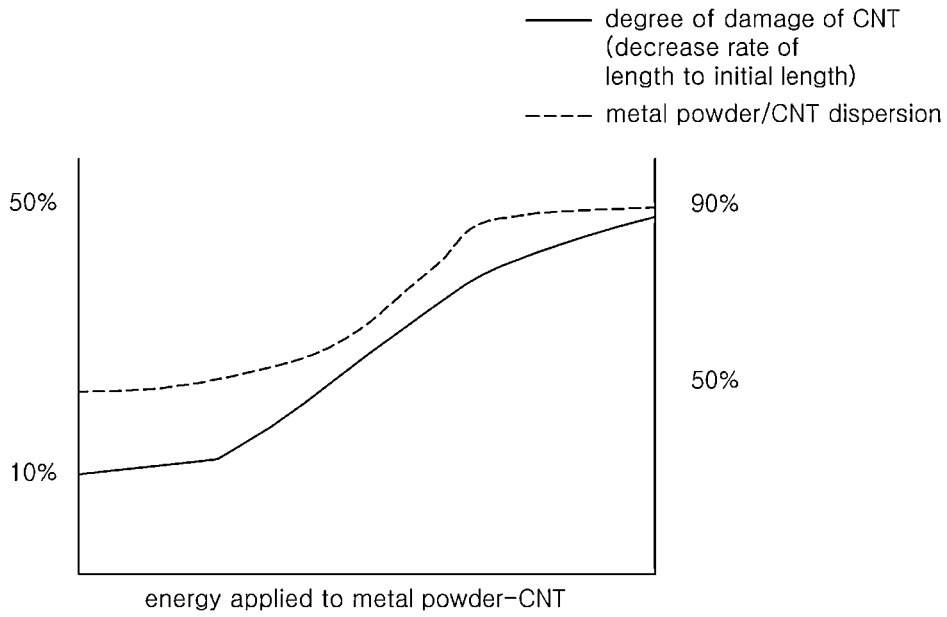
FIG. 5 is an exemplary graph illustrating the effect of an apparatus for dispersing a nanocomposite material according to an exemplary embodiment of the present invention.

Moreover, FIG. 5 is an exemplary graph illustrating the effect of the apparatus for dispersing a nanocomposite material according to an exemplary embodiment of the present invention. In a conventional mixing process, when large pellets are used to increase the dispersion of the metal powder and wall of the nanocomposite material (i.e., CNTs), the nanocomposite material may be damaged. In other words, when the dispersion of mixed powder increases, the degree of damage to the nanocomposite material also increases. Conversely, when the dispersion of the mixed powder decreases, the degree of damage to the nanocomposite material also decreases.

However, in the present invention, the dispersion of the mixed powder may be increased, and simultaneously the degree of damage to the nanocomposite material may be decreased. Therefore, the present invention is effective in obtaining dispersion of about 80% or more and a degree of damage to the nanocomposite material of about 20% or less.

Figure 6:
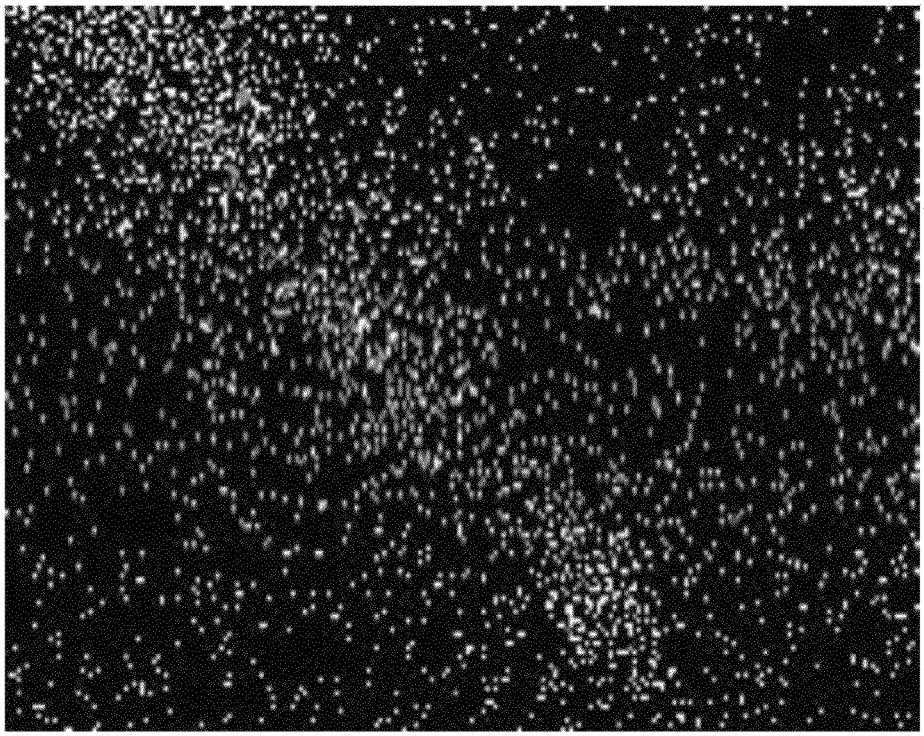
FIGS. 6 and 7 are exemplary views comparing the effect of an apparatus for dispersing a nanocomposite material according to an exemplary embodiment of the present invention with the effect of a conventional nanocomposite material dispersing apparatus according to the related art.
Figure 7:
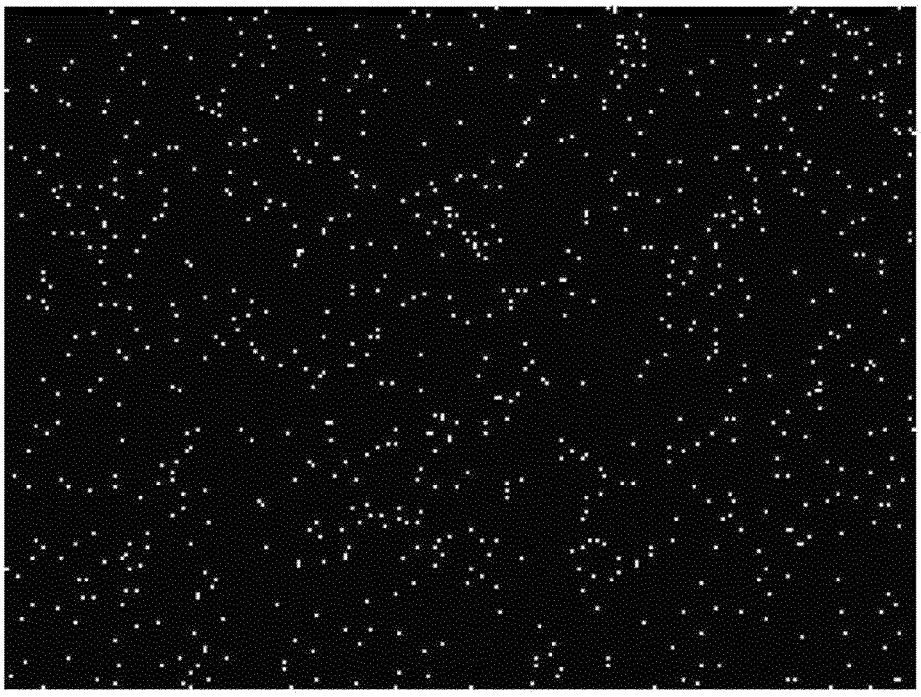

FIGS. 6 and 7 are exemplary views comparing the effect of an apparatus for dispersing a nanocomposite material according to the present invention to the effect of a conventional nanocomposite material dispersing apparatus according to the related are. FIG. 6 illustrates the effect of a conventional nanocomposite material dispersing apparatus, wherein the dispersion of the mixed powder is about 59%, and FIG. 7 illustrates the effect of an apparatus for dispersing a nanocomposite material according to the present invention, wherein the dispersion of the mixed powder is about 78%.

Therefore, FIGS. 6 and 7 illustrate that in the present invention, the dispersion of the mixed powder is greater than that of the conventional nanocomposite material dispersing apparatus, whereas the degree of damage to the nanocomposite material is substantially equal to that of the conventional nanocomposite material dispersing apparatus.

As described above, when the apparatus for dispersing a nanocomposite material according to the present invention is used, the dispersion of the metal powder and the nanocomposite material may increase, and simultaneously the degree of damage to the nanocomposite material may decrease. Therefore, the apparatus for dispersing a nanocomposite material according to the present invention may obtain dispersion of about 80% or more of the metal powder and the nanocomposite material and a degree of damage to the nanocomposite material of about 20% or less, and may use various types of mixed materials.

Although the exemplary embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An apparatus for dispersing a nanocomposite material, comprising:

an inner chamber configured such that a metal powder, a nanocomposite material and a plurality of inner pellets are charged therein, wherein the inner chamber includes a plurality of apertures each having a smaller diameter than each of the inner pellets, and the plurality of apertures are formed in a wall of the inner chamber an outer chamber that surrounds the inner chamber, wherein the outer chamber includes a plurality of outer pellets in a space between the wall of the inner chamber and a wall of the outer chamber; and a control unit operated by a controller and configured to rotate the inner chamber and the outer chamber;

wherein the control unit is operated by the controller such that a mixing time in the outer chamber must not exceed a mixing time in the inner chamber.

2. The apparatus of claim 1, wherein a diameter of each aperture is about 3~10 times larger than the diameter of the metal powder.

3. The apparatus of claim 1, wherein a diameter of each inner pellet is about 10~200 times larger than the diameter of the metal powder.

4. The apparatus of claim 1, wherein the plurality of outer pellets are larger than the plurality of inner pellets.

5. The apparatus of claim 1, wherein a diameter of each outer pellet is about 200~1000 times larger than the diameter of the metal powder.

6. The apparatus of claim 1, wherein the control unit operated by the controller is configured to rotate the inner chamber and the outer chamber to obtain the mixing time in the inner chamber of about 5~300 minutes and the mixing time in the outer chamber of about 5~180 minutes.

7. The apparatus of claim 1, further comprising:

an outermost chamber that surrounds the outer chamber and includes a plurality of outermost pellets in a space between the wall of the outer chamber and a wall of the outermost chamber, wherein the wall of the outer chamber includes a plurality of apertures each having a diameter smaller than that of each outermost pellet.

8. The apparatus of claim 7, wherein the outermost pellets are smaller than the outer pellets.

* * * * *